US008321995B2

(12) United States Patent
Casali et al.

(10) Patent No.: US 8,321,995 B2
(45) Date of Patent: Dec. 4, 2012

(54) PALLET GLIDE WITH STAPLE AND SCREW SUPPORT REGIONS

(75) Inventors: Joseph Casali, Franklin Lakes, NJ (US); Joshua Urso, Jersey City, NJ (US)

(73) Assignee: The Display Connection, Moonachie, NJ (US)

( * ) Notice: Subject to any disclaimer, the term of this patent is extended or adjusted under 35 U.S.C. 154(b) by 0 days.

(21) Appl. No.: 13/081,582

(22) Filed: Apr. 7, 2011

(65) Prior Publication Data

US 2012/0255142 A1 Oct. 11, 2012

(51) Int. Cl.
*A47B 91/06* (2006.01)

(52) U.S. Cl. ..... 16/42 R

(58) Field of Classification Search ..... 16/42 R, 16/42 T; 248/188.9, 188.4, 188.2, 346.11
See application file for complete search history.

(56) References Cited

U.S. PATENT DOCUMENTS

| | | | | |
|---|---|---|---|---|
| 789,510 | A | 5/1905 | Stetson | |
| 2,644,978 | A * | 7/1953 | Becker | 16/42 R |
| 2,902,794 | A * | 9/1959 | Ehrgott | 248/188.9 |
| 3,183,545 | A | 5/1965 | Bergstrom | |
| 3,316,861 | A | 5/1967 | Dailey | |
| 4,106,739 | A * | 8/1978 | Gasser | 248/345.1 |
| 5,220,705 | A * | 6/1993 | Bushey | 16/42 R |
| 5,419,524 | A | 5/1995 | Evans et al. | |
| 5,557,824 | A | 9/1996 | Bushey | |
| 5,713,289 | A | 2/1998 | Model | |
| 5,906,344 | A * | 5/1999 | Atkinson et al. | 248/188.9 |
| 6,299,011 | B1 | 10/2001 | Rosenfeldt | |
| 6,807,911 | B2 | 10/2004 | Carson et al. | |
| 6,857,235 | B2 * | 2/2005 | Niday et al. | 52/301 |
| 7,231,690 | B2 * | 6/2007 | Bushey | 16/42 R |
| 7,607,268 | B2 | 10/2009 | Scherrer et al. | |
| 7,644,666 | B2 | 1/2010 | Smyers | |
| 7,690,315 | B2 | 4/2010 | Apps | |
| 7,712,421 | B2 | 5/2010 | Hartel et al. | |
| 7,784,753 | B2 | 8/2010 | Andreoli | |
| 7,793,386 | B2 | 9/2010 | Gianandrea | |
| 2004/0051014 | A1 * | 3/2004 | Keast et al. | 248/188.9 |
| 2005/0034268 | A1 | 2/2005 | Wurdack | |
| 2007/0234507 | A1 | 10/2007 | Vorpahl | |
| 2008/0148522 | A1 * | 6/2008 | Beshore | 16/42 R |

* cited by examiner

*Primary Examiner* — Chuck Y. Mah
(74) *Attorney, Agent, or Firm* — Michael J. Feigin, Esq.; PatentLawNY.com

(57) ABSTRACT

Embodiments of the disclosed technology are of a glide or furniture/pallet support. The device has a convex base allowing for ease of rotation of a supported device and minimal surface area contacting the ground. The device may be attached to an object by way of a screw hole/aperture centrally placed and/or dimpled regions near the periphery. The device has a circular periphery and a plurality of such devices are used, in embodiments of the disclosed technology, to support an object.

17 Claims, 4 Drawing Sheets

PALLET GLIDE WITH STAPLE AND SCREW SUPPORT REGIONS

FIELD OF THE DISCLOSED TECHNOLOGY

The disclosed technology relates generally to support bases for furniture and pallets, and more specifically towards convex support bases with designated staple and screw support regions.

BACKGROUND OF THE DISCLOSED TECHNOLOGY

Furniture and pallet glides are structures which are attached to the bottom of a large piece of furniture or a pallet. Such glides prevent floor scratching or allow a heavy item to be dragged across a floor more easily, by decreasing surface area on the ground and/or by being made of a material with a different coefficient of friction than that of the item to which they are attached.

For example, U.S. Pat. No. 5,557,824 to Bushey discloses a triangular shaped support for use beneath corners of furniture. Others include U.S. Pat. No. 7,690,315 to Apps and U.S. Pat. No. 5,713,289 to Model. While these references accomplish the above-stated goals in various degrees, it is desirable for such items to be the least expensive to procure and provide the least surface area touching the ground, while remaining strongly and fixedly attached to a pallet or piece of furniture.

These and other features of the present technology advance the state of the art in the field of supports for large objects.

SUMMARY OF EMBODIMENTS OF THE DISCLOSED TECHNOLOGY

An object of the disclosed technology is to provide a pallet or furniture (used interchangeably in this disclosure) glide or support. It is an object of the disclosed technology to allow a pallet to swivel or be angled from the ground, while still being supported by the glide or support item. It is a further object for the glide to be procured from a unitary structure, such as a plastic or polymer which is inexpensive to produce and light in weight. It is still another object of the disclosed technology to provide simple mechanisms for attachment, such as via a screw or nail (used interchangeably in this disclosure), with support for the head of the screw or nail, and/or a staple or plurality thereof.

In an embodiment of the disclosed technology, the furniture or pallet support has a top side and bottom side joined at an edge, a convex exterior portion on the bottom side, at least three spaced apart dimples on the bottom side, each extending inward from the joined edge. In embodiments, an aperture extends through the top and bottom side. An additional dimpled region on the bottom side may circumferentially surround the aperture, such as to support a head of a screw or nail when the product is nailed into a bottom of a piece of furniture or a pallet. Likewise, the spaced apart dimples extending from the edge are adapted for staples placed therethrough and may include a vertically extending staple. "Vertically" in this case, is defined as extending up from the generally flat surface of the dimple; such as, extending towards a lower extremity of the device. The staple support may be perpendicular to the plane of the edge of the device, along one or two axes.

The spaced apart dimples may also form upper extremities of the top side, such that they lie flush against a piece of furniture, et al., when attached thereto. So too, ribbing may further comprise part of the upper extremity. The device may be procured from a unitary structure and made from a polymer.

In another embodiment, which may overlap with the previously described embodiment, partially or fully, a circular disc adapted for attachment to a base of an object has an attachment side (abutment side, for abutment against the base) with spaced apart flat regions, wherein the flat regions are adapted for staple punctures through each flat region; a convex region on a side opposite the attachment side; and a depression at the apex of the convex region, adapted to support a head of a screw or nail, the depression surrounding an aperture passing through the attachment side and the side opposite the attachment side.

The circular disc may have a staple support flange, or a plurality thereof, and a plurality of ribbed support flanges extending outwards from the aperture. Each spaced apart flat region may be joined to one of the ribbed support flanges, with a staple support flange extending in line to a support flange. The ribbed support flanges may also join at a circular ribbed support, the circular ribbed support forming the depression surrounding the aperture.

The attachment side may be fixedly held to the base of the object via a screw or nail passing through the aperture, wherein the head of the screw or nail abuts the depression surrounding the aperture. Or, the attachment side may be fixedly held to the base, and the device in general held to the base, via a plurality of staples, wherein at least one staple straddles a staple support flange. A combination of these attachment mechanisms may also be utilized.

A convex circular furniture glide, in an embodiment of the disclosed technology, has a top side, convex bottom side, and circular edge between the top side and the generally convex bottom side. It also has equidistantly spaced ribs extending from the circular edge towards a midpoint of the circular edge, an aperture extending through the midpoint of the circular edge, and a circular depression in the convex side spaced around the midpoint of the circular edge. The ribs may extend to the circular depression, the furniture glide may be a unitary structure, at least three of the ribs may terminate at a flat dimple of the generally convex button side, and the generally convex side may be entirely convex, with the exception of the flat dimple regions, the aperture, and the circular depression. "Generally convex" is defined herein as the majority of surface area of a side being unitarily of a convex shape. A plurality of the glides may be attached to a base of a piece of furniture or pallet and support the piece of furniture or pallet above the ground.

A better understanding of the disclosed technology will be obtained from the following detailed description of the preferred embodiments, taken in conjunction with the drawings and the attached claims.

DETAILED DESCRIPTION OF EMBODIMENTS OF THE DISCLOSED TECHNOLOGY

Embodiments of the disclosed technology comprise a convex circular furniture glide or pallet support. The device has a top side with flush top regions, enabling the device to sit flatly against a pallet or piece of furniture. The upper extremities may include a circular edge, ribbing, and dimples or depressions with flat, longitudinal regions for placement of staples therethrough to attach the device to a pallet or piece of furniture. Multiple such devices may be attached in this manner, utilizing multiple glides to aid the supporting and moving of, or prevent scratching of, a heavy object or the floor. The ribbing may be equidistantly spaced, and extend from a central region.

At the central region, which is in the midpoint of the circular edge, an aperture is present, in embodiments of the disclosed technology. This aperture or portal passes through the device and allows the device to be attached to a pallet via a screw or nail. To aid in this, a circular depression, extending into the bottom side, which may also be circular ribbing where the other ribbing joins and forms a unitary structure therewith, supports the head of a screw or nail. The bottom side is generally convex (at least 50% of the side being convex, and the convexity extending to at least two or three points of the edge). The convexity is broken up, in embodiments of the disclosed technology, by the flat dimpled regions designed for staples to pass therethrough and/or the central aperture with a depression for screw/nail head support. In some embodiments, these are the only functional regions which break up the convexity (for purposes of this disclosure, raised indicia or writing is defined as "non-functional"). The convex bottom allows for tilting of a pallet while still being supported.

Embodiments of the disclosed technology will become clearer in view of the following description of the figures.

Figure 1:
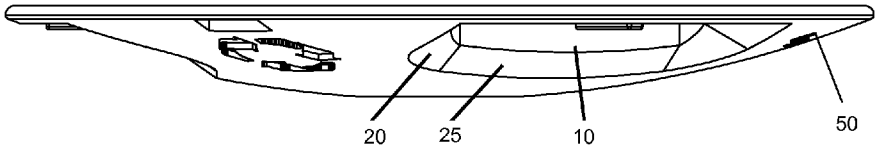
FIG. 1 shows a side elevation view of the pallet support device of an embodiment of the disclosed technology.
Figure 2:
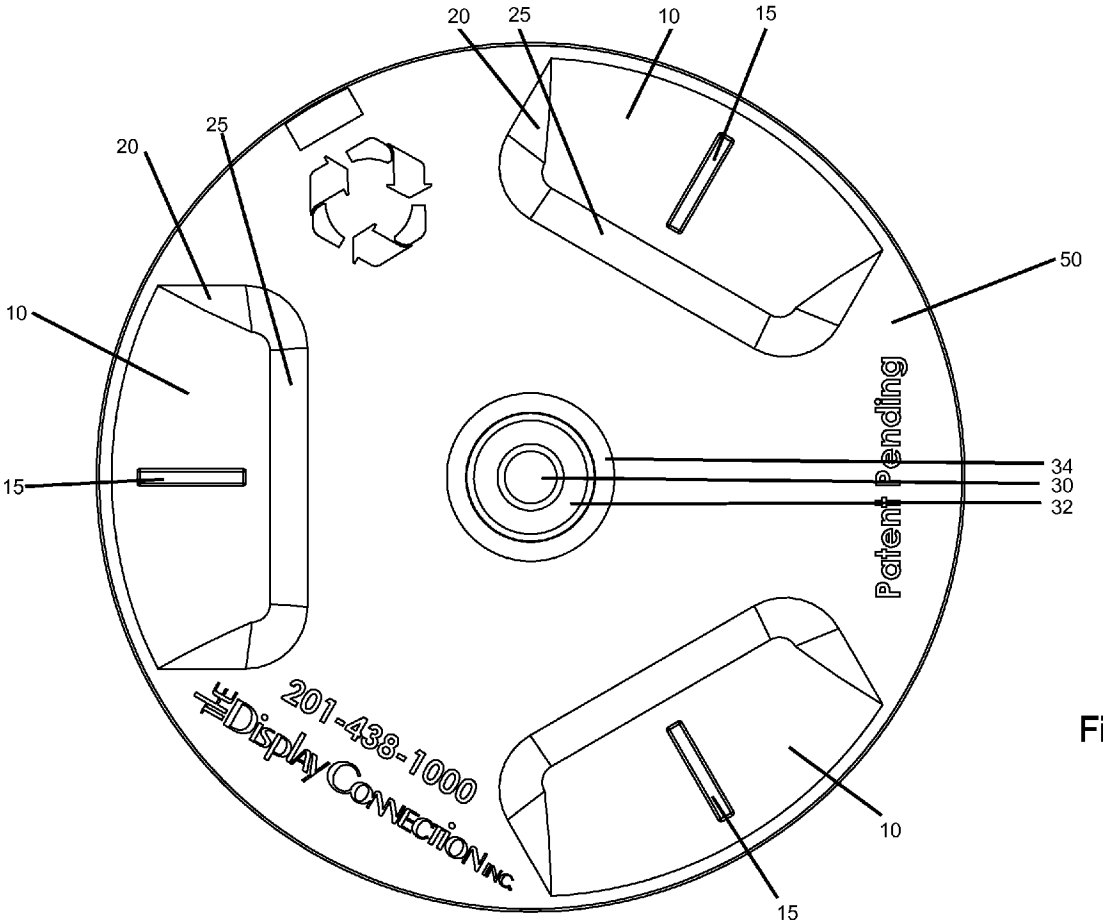
FIG. 2 shows a bottom plan view of the pallet support device of an embodiment of the disclosed technology.

FIG. 1 shows a side elevation view of the pallet support device of an embodiment of the disclosed technology. FIG. 2 shows a bottom plan view of the pallet support device of an embodiment of the disclosed technology. Three dimples 10, or planar indentations, are shown within the circular disc, which is the pallet glide. The dimples 10 have a side flush with, and of the same elevation (see elevation view of FIG. 1) as, the edge of a circular device. In this manner, a stapler may be easily placed in the indentation to force a staple through the dimple 10. For extra support, in embodiments of the disclosed technology, within a dimple 10 may be a staple support 15, or vertical support rising out of the plane of the dimple 10, towards a lower extremity of the device (recall that FIG. 2 is a bottom plan view).

The dimple 10, or depression, is surrounded further by side walls 20 (on each side, though only labeled on one) and a back wall 25, these side and back walls joining with the generally convex bottom surface 50 of the device. The breaks in this convexity, in embodiments of the disclosed technology, are limited to the dimples 10 with their walls (considered to be part of the dimple for claim purposes), as well as the aperture 30 or portal passing through the center of the device. The aperture 30, in embodiments of the disclosed technology, is at a midpoint of the circular device and is surrounded by a depression 32, which may be circular ribbing around the aperture. This depression supports a screw or nail head, with the body thereof passing through the aperture 30 and fastening/fixedly abutting the glide device to a pallet or other object. Side walls 34 are perpendicular to the depression 32, the depression being parallel to the (imaginary) apex point of the convex surface 50 and/or parallel to the upper extremities of the device.

Figure 4:
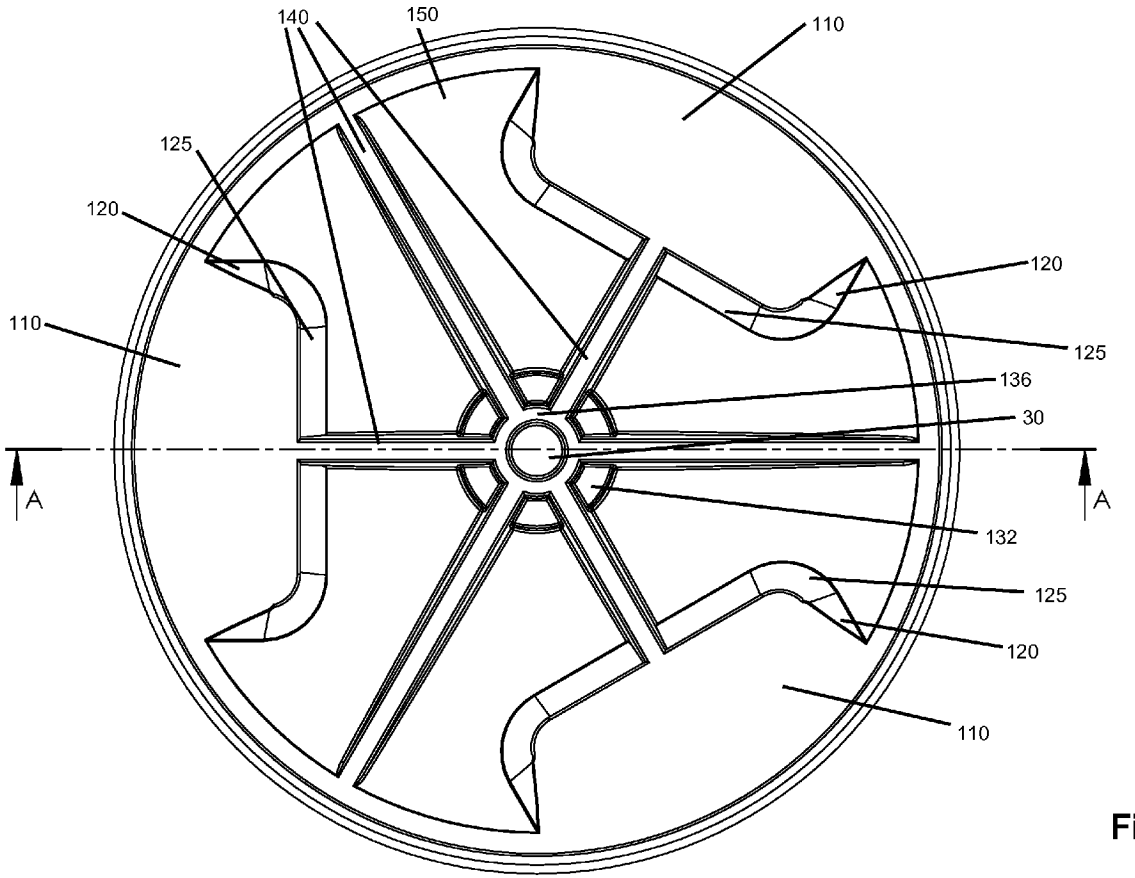
FIG. 4 shows a top plan view of the pallet support device of an embodiment of the disclosed technology.

Skipping now to FIG. 4, FIG. 4 shows a top plan view of the pallet support device of an embodiment of the disclosed technology. This top side is also called an "attachment side" or "abutment side" in this disclosure, as it abuts or sits flush against an object to which it is attached in embodiments of the disclosed technology. Concave side 150 is the underside of convex side 50, the convex/concave portion supported by ribbing 140 which extends outward from a central point, towards the flat regions 110 (the underside of dimples 10) and/or the edge of the circular disc. The flat regions 110 are connected with the concave portion 150 (the opposite side of the material forming convex portion 50) by back walls 125 and side walls 120, the back walls 125 forming a unitary structure with ribbing 140, in embodiments of the disclosed technology. The ribbing 140 serves as structural support and allows the device to be of lighter material and require less material than if the area between the convex lower region 50 and the upper extremities of the device were filled in with material, though such an embodiment is also contemplated and within the scope and spirit of the disclosed technology.

Referring still to FIG. 4, at a midpoint of the circular edges of the device, an aperture or portal 30 extends completely through the device, in embodiments of the disclosed technology. This portal is surrounded by ribbing 136 on the top side, in an embodiment of the disclosed technology. This ribbing may be circular, and circumferentially surround the aperture or portal 30 as well as unitarily connect to the ribbing 140 which extends outward from the circular ribbing 136, towards the edges. The ribbing 140 may be like spokes, extending from a center point, albeit bisected by the aperture 30. The depression 32, described with reference to FIG. 2, has a top side 132 which may further aid as support for, and be unitarily connected to, the ribbing 140 and 136. In addition, the converse is also true. A nail or screw entering through the aperture on the bottom side of the glide device and pressing against the depression 32/132, is supported by the material forming the depression 32/132, the circular rib 136, and the longitudinal ribs 136 which each serve to disperse pressure against the depression 32/132 by the nail or screw head. The ribbing 140 may be equidistantly spaced around the midpoint of the device (the midpoint being defined as halfway between the diameter of the circular axis/edges of the device).

Figure 3:
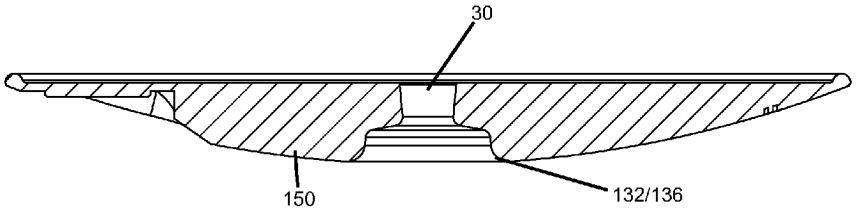
FIG. 3 shows a cutaway view along section line A-A of FIG. 4.

FIG. 3 shows a cutaway view along section line A-A of FIG. 4. Note the convex shape of the lower portion, and the dimple formed on the left side of the drawing corresponding to a dimple 110 shown in FIG. 4. The portal 30 extends through the device, the bottom side having side walls and a depressed area within the convex structure 132/136 which supports the head of a screw or nail. The orientation shown in FIG. 3 would be a typical orientation when the device is in use; that is, attached to a pallet, piece of furniture, or other heavy object. The flat upper portion is the top side or attachment side which abuts against the object to which it is attached, and the generally (at least 50%) convex side rests on the ground. Multiple such devices may be attached to the bottom of an object allowing them to serve as feet for a device, and when tilted, the glide allows for support while in such a tilted configuration.

Figure 5:
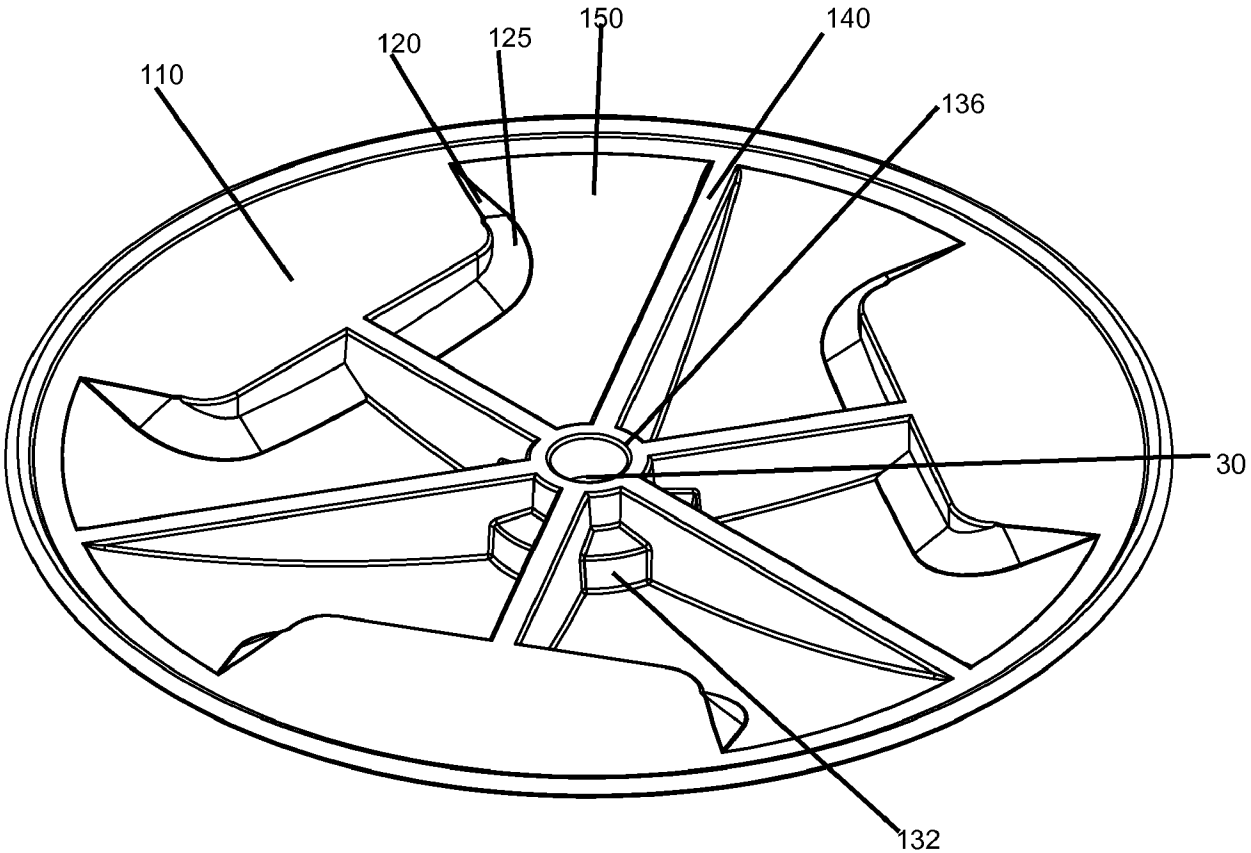
FIG. 5 shows a top perspective view of the pallet support device of an embodiment of the disclosed technology.

FIG. 5 shows a top perspective view of the pallet support device of an embodiment of the disclosed technology. The generally convex shape (convex from this orientation) of the bottom of the device is apparent in this Figure. The edge of the device, between the bottom side and top side, is a perfect circle (within a reasonable tolerance level accepted in the industry, such as plus or minus 2%). This circular edge forms an upper extremity of the device, with other upper extremities possibly being the ribbing 136 and 140, as well as the flat regions 110 which are the back sides of the dimples 10, adapted for passing a staple there through. The underside of the depression 32/132 situated around the central axis and portal or aperture 30 is also visible. This depression 132 supports a head of a screw or nail, the body of which passes through the portal 30 and embeds in an object to which the glide device (pallet support) is attached.

Figure 6:
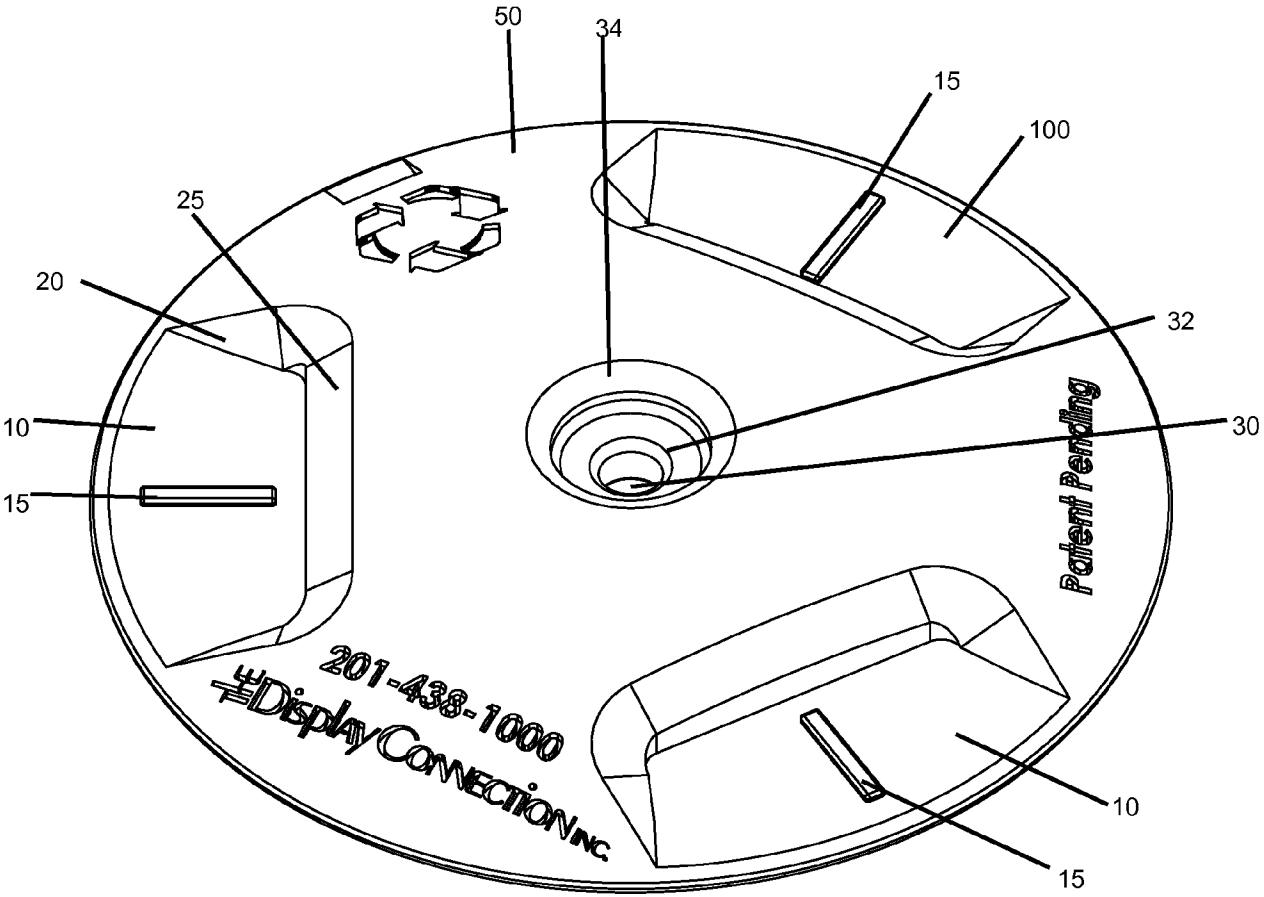
FIG. 6 shows a bottom perspective view of the pallet support device of an embodiment of the disclosed technology.

FIG. 6 shows a bottom perspective view of the pallet support device of an embodiment of the disclosed technology. Note that this view is "upside down" in that, in use, this side of the device would face towards, and make contact with, the ground. The generally convex shape 50 of the device between the circular edges (the edges connecting the upper and lower sides of the device) allows the glide device to support a large object at a variety of orientations. Thus, for example, when moving a large object, one may tilt it forward. Tilting becomes easier than is generally found in the prior art because the convex nature of this bottom portion 50 of the device allows one to roll a large object over the device. Then, instead of the most extreme region of the convex shape (that is, near the midpoint and aperture 30) touching the ground, an area closer to the circular edge touches the ground. Similarly, on unleveled or bumpy surfaces, the device may rest thereon, in an off-center manner.

Still referring to FIG. 6, the depth of the dimples 10 is visible, as well as the vertically rising staple support or flange 15. The staple support or flange 15, in an embodiment of the disclosed technology, rises vertically out of the plane of the surface of the dimple 10, towards the lower extremity of the glide device. Still further, it may be in line with the ribbing 130 (see FIG. 5). As such, when a staple is placed with a prong on each side of the flange 15, the central region of the staple is supported by the flange, preventing the staple from pulling through the relatively thin dimple region 10.

Note also, in FIG. 6, the side walls 34 leading to the depressed region 32 which supports a screw or nail head, and the aperture or portal 30 where the body of a screw or nail may pass through. As such, the glide device may be attached to an object through its center by way of a screw/nail, and/or attached at the dimpled regions 10 by way of one or more staples.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalence of the claims are to be embraced within their scope. Combinations of any of the methods, systems, and devices described herein above are also contemplated and within the scope of the disclosed technology.

We claim:

1. A furniture/pallet support, comprising:
- a top side and bottom side joined at a common edge;
- a convex exterior portion on said bottom side;
- at least three spaced apart dimples on said bottom side, each extending inward from said joined common edge.

2. The furniture/pallet support of claim 1, further comprising an aperture extending through said top and bottom sides.

3. The furniture/pallet support of claim 2, wherein a dimpled region of said bottom side circumferentially surrounds said aperture.

4. The furniture/pallet support of claim 1, wherein said spaced apart dimples of said bottom side comprise a vertically extending staple support.

5. The furniture/pallet support of claim 4, wherein said at least three spaced apart dimples on said bottom side correspond to upper extremities of said top side.

6. The furniture/pallet support of claim 5, wherein said upper extremities further comprise ribbing.

7. The furniture/pallet support of claim 1, wherein said support is a unitary structure formed from a polymer.

8. A circular disc adapted for attachment to a base of an object, comprising:
- an attachment side with spaced apart flat regions designed for abutment with said base, wherein said flat regions are adapted for staple punctures through each flat region;
- a convex region on a side opposite said attachment side; and
- a depression, at the apex of said convex region, adapted to support a head of a screw or nail, said depression surrounding an aperture passing through said attachment side and said side opposite said attachment side.

9. The circular disc of claim 8, wherein each said flat region comprises a staple support flange on said side opposite said attachment side.

10. The circular disc of claim 9, wherein a plurality of ribbed support flanges extend from said aperture.

11. The circular disc of claim 10, wherein each said spaced-apart flat region is joined with a said ribbed support flange.

12. The circular disc of claim 11, wherein said plurality of ribbed support flanges join at a circular ribbed support, said circular ribbed support forming said depression surrounding said aperture.

13. The circular disc of claim 12, wherein when said circular disc is attached to said base of said object, said attachment side is fixedly held to said base of said object via a screw or nail passing through said aperture, and the head of said screw or nail abuts said depression surrounding said aperture.

14. The circular disc of claim 9, wherein when said circular disc is attached to said base of said object, said attachment side is fixedly held to said base of said object via a plurality of staples, and at least one staple of said plurality of staples straddles a said staple support flange.

15. A convex circular furniture glide comprising:
- a top side, generally convex bottom side, and circular edge between said top side and said generally convex bottom side;
- equidistantly spaced ribs extending from said circular edge towards a midpoint of a circle corresponding to said circular edge;
- a second set of equidistantly spaced ribs, each extending from a different flat dimple of said generally convex side towards said midpoint of a circle corresponding to said circular edge;
- an aperture extending through said midpoint of said circular edge;
- a circular depression in said convex side spaced around said midpoint of said circular edge;
- wherein said furniture glide is a unitary structure.

16. The convex circular furniture glide of claim 15, wherein said generally convex side consists of functional non-convex portions which are flat dimple regions, said aperture, and said circular depression.

17. A method of using said convex circular furniture glide of claim 15, comprising steps of attaching a plurality of said glides to a base of a piece of furniture or pallet; and supporting said piece of furniture or pallet above the ground.

* * * * *